US005321592A

United States Patent [19]

Marinacci

[11] Patent Number: 5,321,592

[45] Date of Patent: Jun. 14, 1994

[54] LOW VOLTAGE OUTDOORS LIGHTING SYSTEM INSTALLED BY HAND WITHOUT TOOLS

[75] Inventor: Angelo Marinacci, Casarile, Italy

[73] Assignee: Fonderal S.r.l., Casarile, Italy

[21] Appl. No.: 775,988

[22] PCT Filed: Aug. 8, 1989

[86] PCT No.: PCT/IT89/00059

§ 371 Date: Nov. 14, 1991

§ 102(e) Date: Nov. 14, 1991

[87] PCT Pub. No.: WO90/14698

PCT Pub. Date: Nov. 29, 1990

[30] Foreign Application Priority Data

May 26, 1989 [IT] Italy ..... 20665 A/89

[51] Int. Cl.[5] ..... H01R 33/06

[52] U.S. Cl. ..... 362/226; 362/391; 362/431; 439/419

[58] Field of Search ..... 362/252, 226, 249, 391, 362/431, 806; 439/419, 425, 426, 488, 489

[56] References Cited

U.S. PATENT DOCUMENTS

| | | | |
|---|---|---|---|
| 1,508,206 | 9/1924 | Waters | 362/431 |
| 2,261,419 | 11/1941 | Shamn | 439/425 |
| 2,647,246 | 7/1953 | Gilbert | 439/419 |
| 2,745,078 | 5/1956 | Wood | 439/425 |
| 2,884,555 | 4/1959 | Peterson | 439/425 |
| 3,231,731 | 1/1966 | McDonald | 362/226 |
| 4,781,619 | 11/1988 | Ikeda | 439/488 |
| 4,858,877 | 8/1989 | Carter | 362/431 |
| 4,911,656 | 3/1990 | Yu | 439/425 |
| 5,065,292 | 11/1991 | Aubrey | 362/226 |

*Primary Examiner*—Ira S. Lazarus
*Assistant Examiner*—Y. Quach
*Attorney, Agent, or Firm*—Michael J. Striker

[57] ABSTRACT

Outdoor lighting system including several lamps fixed in the ground by tubular rods and a flat supply cable laid on the ground and having two side-by-side wires of indefinite length for carrying electricity at a low voltage to the lamps. The electrical connection of the supply cable to a branch cable from each lamp is made by placing the supply cable in a longitudinal channel in the body of a terminal box of insulating material from which emerge the sharp points of contacts connected to the wires in the branch cable and positioned for engagement with the two wires in the supply cable, the channel being closed by a cover slidable over the terminal box body into a secured position in a longitudinal direction by hand without tools.

2 Claims, 4 Drawing Sheets

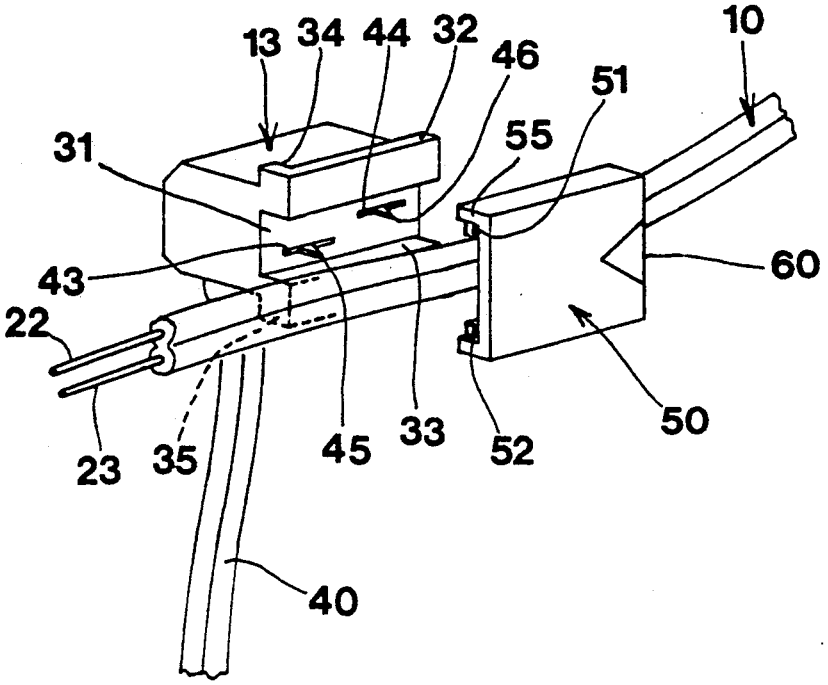
fig. 5
fig. 6
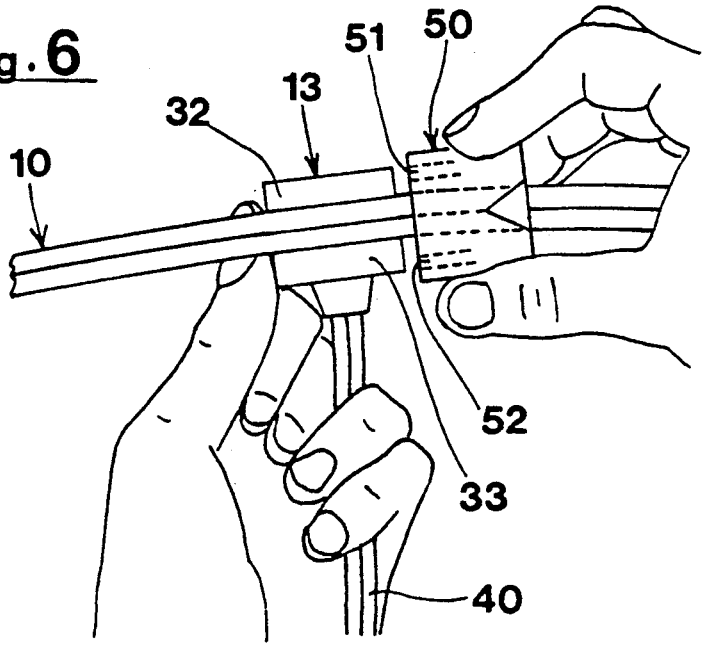

LOW VOLTAGE OUTDOORS LIGHTING SYSTEM INSTALLED BY HAND WITHOUT TOOLS

BACKGROUND OF THE INVENTION

The invention concerns a lighting system for outdoor use. Considerable difficulties attend the installation of lighting systems outside buildings, in parks and gardens, around villas, especially close to swimming pools, near the sea and in similar places, both because of specific differences in these environments and because of the need to ensure that electric cables and lamps are perfectly sealed.

Connections from each lamp to the main electric cable involve complex and delicate operations to avoid damaging the cable and, on completion of the work, to make sure it is once more perfectly sealed against current leakage especially near water or in damp places of any kind. Climatic and ground conditions in the open to which such lighting systems are exposed, apart from the care taken over installation as stated above, make necessary thorough checking and maintenance which can be costly.

SUMMARY OF THE INVENTION

The above invention eliminates the above-mentioned disadvantages offering important advantages as well to be explained below.

According to the invention, main current is brought to the lighting means by a substantially flat supply cable, of indefinite length, consisting of two wires placed side by side and coated with highly resistent waterproof plastic material, so as to be suitable for installation purposes by simply laying it on the ground, this cable being connected to the main.

Connection at any point between the supply cable and the one leading off to each lamp is made by an insulating plastic terminal box placed at the end of the latter cable.

The ends of the lamp wires are inserted into the body of the terminal box and fixed to metal contacts having sharp points emerging from the terminal box.

Contact between the points and the wires of the supply cable can therefore be made by simply mounting the cable inside the terminal box which is then closed by hand with no need for tools.

The supply cable is connected to the mains through a transformer preferably placed outside the building whose surroundings are to be illuminated.

Current downstream the transformer is therefore low voltage.

Voltage for the system is preferable 12 V.

The substantially parallelepiped-shaped terminal box has a longitudinal channel of a constant U-shaped cross section, width and depth which are respectively about equal to the width and thickness of the supply cable.

The two sharp points of the internal contacts emerge from the channel, symmetrically, one at each end of its longitudinal axis. The lateral distance across the channel between the two being practically the same as that between the two wires of the supply cable.

Therefore, by simply pressing the supply cable by hand inside the channel, the two sharp points of the collector can be made to penetrate the cable's plastic coating and make contact with its two wires.

The supply cable is held firmly in place inside the channel in the terminal box by a sliding cover put on by hand. The sliding cover has a constant C-shaped cross section in which there are two longitudinal lateral grooves which, on closing the terminal box, fit onto the longitudinal outward-projecting edges of the terminal box, one on each side of the channel.

The width of the grooves diminishes slightly from one end to the other so that, when pushing the cover onto the box, extra elastic pressure is created between the longitudinal outward-projecting edges of the box and said grooves. In this way, when the box is fully closed, connection between box and cover is stabilized and a waterproof seal is formed.

On each side of the longitudinal symmetrical axis inside the cover there are longitudinal ridges whose height increases from the end of the terminal box, where the above grooves are of maximum width, to the other end.

Centre distance between these ridges is substantially the same as that of the wires in the supply cable, consequently as the cover is being pushed onto the terminal box pressure from the ridges on the cable increases thereby making stable the connection between the collectors in the terminal box and the wires in the cable.

The longitudinal position of the two points of the terminal box collectors is uneven in relation to the transverse axis of symmetry of the terminal box, the purpose of this being to increase the space between said collectors and therefore improve electrical insulation. The coating over one wire of the supply cable differs in shape or colour from the coating over the other wire in order to make possible correct connection of the various illuminating bodies to the wires.

The illuminating bodies are mounted on a tubular rod that can be easily pressed into the ground as its bottom end is cut at an angle of 45°.

The length to be pressed into the ground is marked by a ring nut mounted on the tubular rod above, the remaining length to be left above ground, both lengths complying with present regulations.

The light bulb used for one of the types of lamp is that used for motor vehicles mounted by a bayonet connection.

The advantages of the invention are clearly evident. The low voltage in the system deprives it of any risk to persons or animals and facilitates installation.

Connections between a lamp and the main supply cable are made simply and quickly using the hands only without the need for any tools.

On completion of the work watertightness of each connection is assured and nothing further needs to be done.

An illuminating body can be fitted at any point along the main supply cable which can be left lying on the ground without any further protection in whatever state the surface of the ground may be.

The kind of coating given to the supply cable, differentiating one wire from another, ensures that the lamp will be properly connected to said wires and that uniform electric power will be supplied to each body.

BRIEF DESCRIPTION OF THE DRAWING

The objects, features and advantages of the present invention will now be illustrated in more detail by the following detailed description, reference being made to the accompanying drawing in which:

FIG. 5 is an exploded perspective view of the terminal box and supply cable in the lighting system of FIG. 1;

FIG. 6 is a plan view showing assembly of the terminal box of FIG. 5 during installation.

DESCRIPTION OF THE PREFERRED EMBODIMENT

Figure 4:
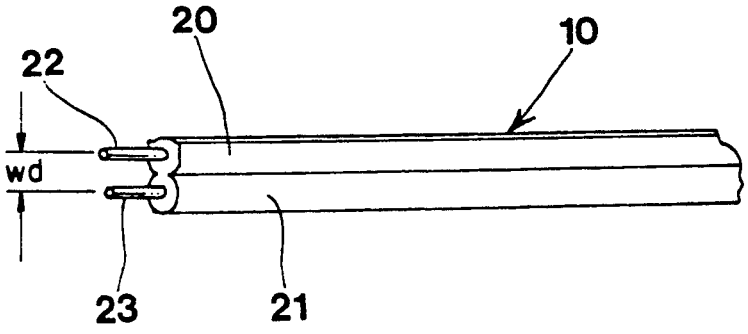
FIG. 4 is a perspective view of the two-wire supply cable in the lighting system of FIG. 1 for supplying electricity to the lamps.

The outdoor lighting system according to the invention comprises a two-wire supply cable 10 that is connected to the waterproof current transformer 11 placed outside the building 12 and a number of terminal boxes by which electrical connection to the lamps 14 can be made at any position along the cable. The transformer 11 reduces mains voltage down to 12 V. Structure of the cable 10 (FIG. 4) is asymmetric. The cable 10 has two waterproof sheaths 20 and 21 for the electric wires 22 and 23 placed side by side.

The sheaths are joined longitudinally and are of different shapes.

The cross section of sheath 20 is practically quadrangular while that of sheath 21 is substantially circular.

This helps to distinguish one wire from the other when the terminal boxes, through which electrical connection to the illuminating bodies is made, are being attached. Each terminal box 13 comprises a substantially parallelepiped body 30 with a longitudinal square U-shaped channel 31. The body 30 has side wall portions 32 and 33 projecting outward from the body 30 on opposite sides of the channel 31 which provide side walls for the channel 31. The side wall portions 32 and 33 have shoulders 34 and 35 at an end of the body 30 which provide stop surfaces.

The electric wires 41 and 42 in the branch cable 40 are fixed to contacts 43 and 44 respectively, these being fitted into the body 30 of the terminal box so as to remain substantially flush with the bottom surface bc of the channel 31 with the triangular points 45 and 46 projecting into the channel 31.

The contacts are situated in the middle of the channel at a lateral distance LD perpendicular to the longitudinal axis of the body 30 equivalent to half the width W of the channel and lie, longitudinally, at different positions to increase the distance between them and therefore improve electrical insulation.

The width W of the channel 31 is substantially equal to that of the cable 10.

Figure 1:
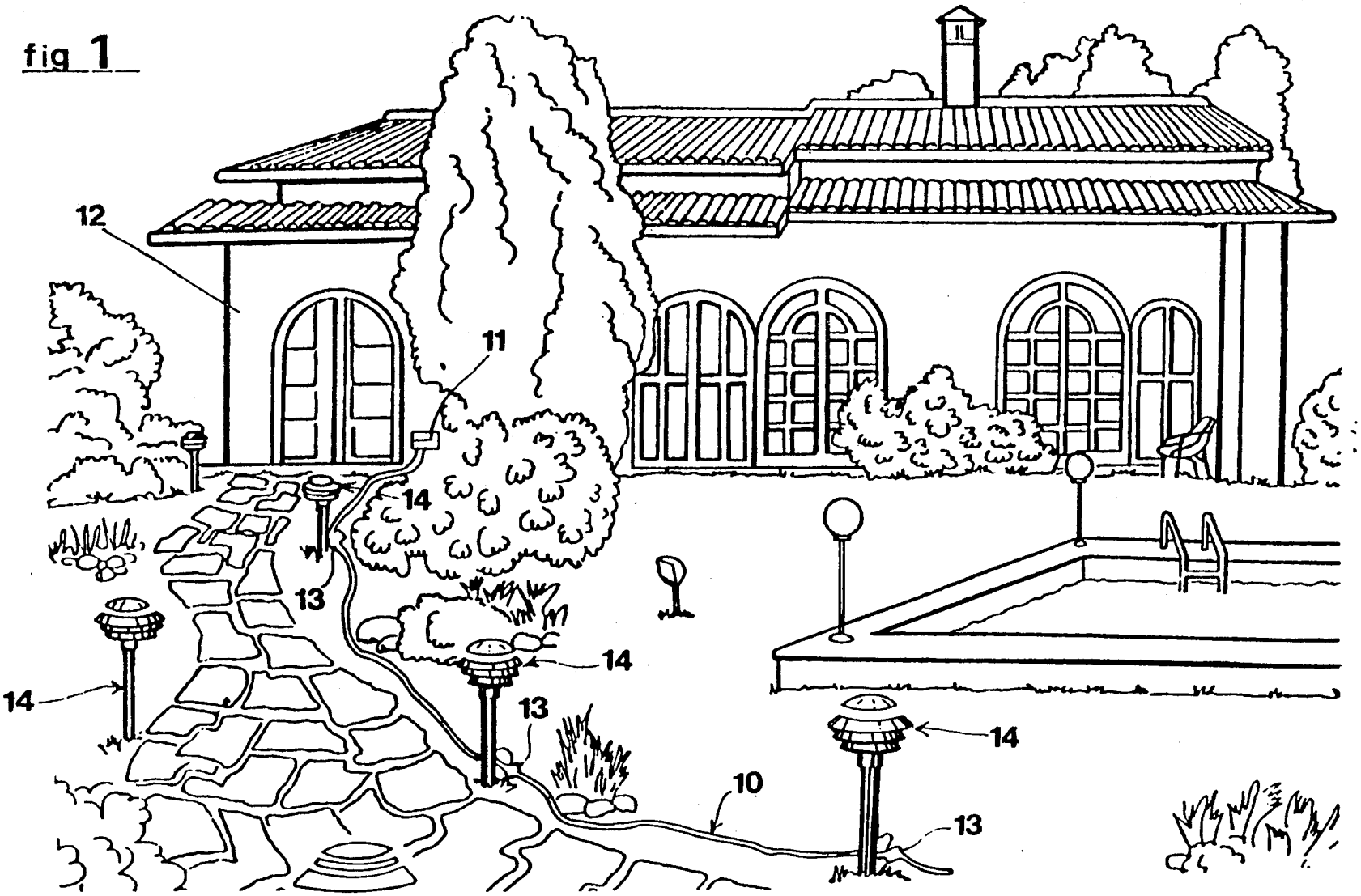
FIG. 1 is a perspective view of a portion of an outdoor lighting system according to the invention installed around a house with a swimming pool.
Figure 2:
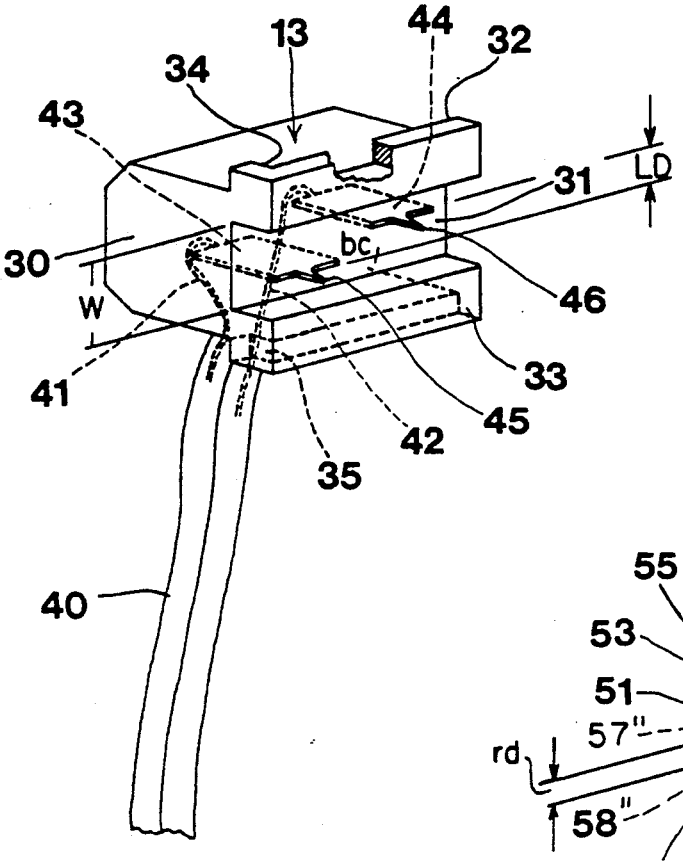
FIG. 2 is a perspective view of a terminal box for connecting a lamp in the lighting system shown in FIG. 1.
Figure 3:
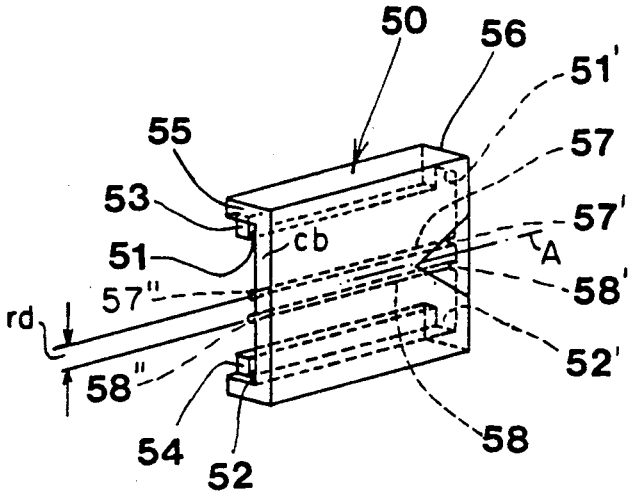
FIG. 3 is a perspective view of a push-on cover of the terminal box shown in FIG. 2.

The depth of the channel is practically the same as the thickness of the cable 10 which, when mounted inside the channel 31 of the terminal box 13 is held fixed when the cover 50 (FIG. 3) whose cross section is C-shaped is slit on the body 30. Internal width of the C-shaped transverse cross section is practically the same as the total width of the terminal box 13 including the projecting side wall portions 32 and 33.

The width of the grooves 51 and 52, created in the longitudinal cover sides 53 and 54 of the C-shaped cross section decreases from the end portion 56 of the terminal box to the one opposite end portion 55. Initial width 51' and 52' of the grooves 51 and 52 is a little greater than the thickness of the projecting side wall portions 32 and 33 while their final width is slightly less than that thickness.

On the cover base cb of the cover 50 there are parallel ridges 57 58, symmetrically placed relative to the longitudinal axis of the cover 50. The distance rd between these ridges 57 and 58 is approximately equal to the distance wd between the two wires of the supply cable 10 so that the ridges 57 and 58 can press the supply cable 10 onto the points 45 and 46 as the cover is slid on the oblong body.

The height of these ridges gradually increases from the one end 57' 58' to the opposite end 57" 58". The terminal box 13 is mounted on the cable 10 as illustrated in FIGS. 5 and 6.

FIG. 5 shows the terminal box 13 placed in proximity to the cable 10, and the cover 50 placed opposite it. Cable 10 is inserted inside the channel 31 into which it fits exactly, the width of the channel and width of the cable 10 being practically the same, and, similarly, the depth of the channel and the thickness of the cable 10 being approximately the same The cable 10 is then lodged inside the channel 31, point 45 of contact 43 and point 46 of contact 44 simultaneously being inserted in wires 23 and 22 respectively.

At this stage the cover 50 can be put onto the projecting side wall portions 32 and 33 of the terminal box, making them penetrate into the grooves 51 and 52.

By pushing along the cover 50 as indicated by the arrow 60, the projecting side wall portions 32 and 33 gradually meet a decreasing cross section of the grooves so that, by sliding the cover until its end 55 abuts on contacting surfaces of shoulders 34 35 of the side wall portions 32 and 33, the cover 50 will be securely fixed. In the same way connections of contacts 43 and 44 will be respectively made with wires 23 and 22 of the cable 10.

FIG. 6 clearly shows that the attachment of the terminal box to the cable 10, and of the cover to the terminal box, is done by the hands only without tools or anything else.

Figure 7:
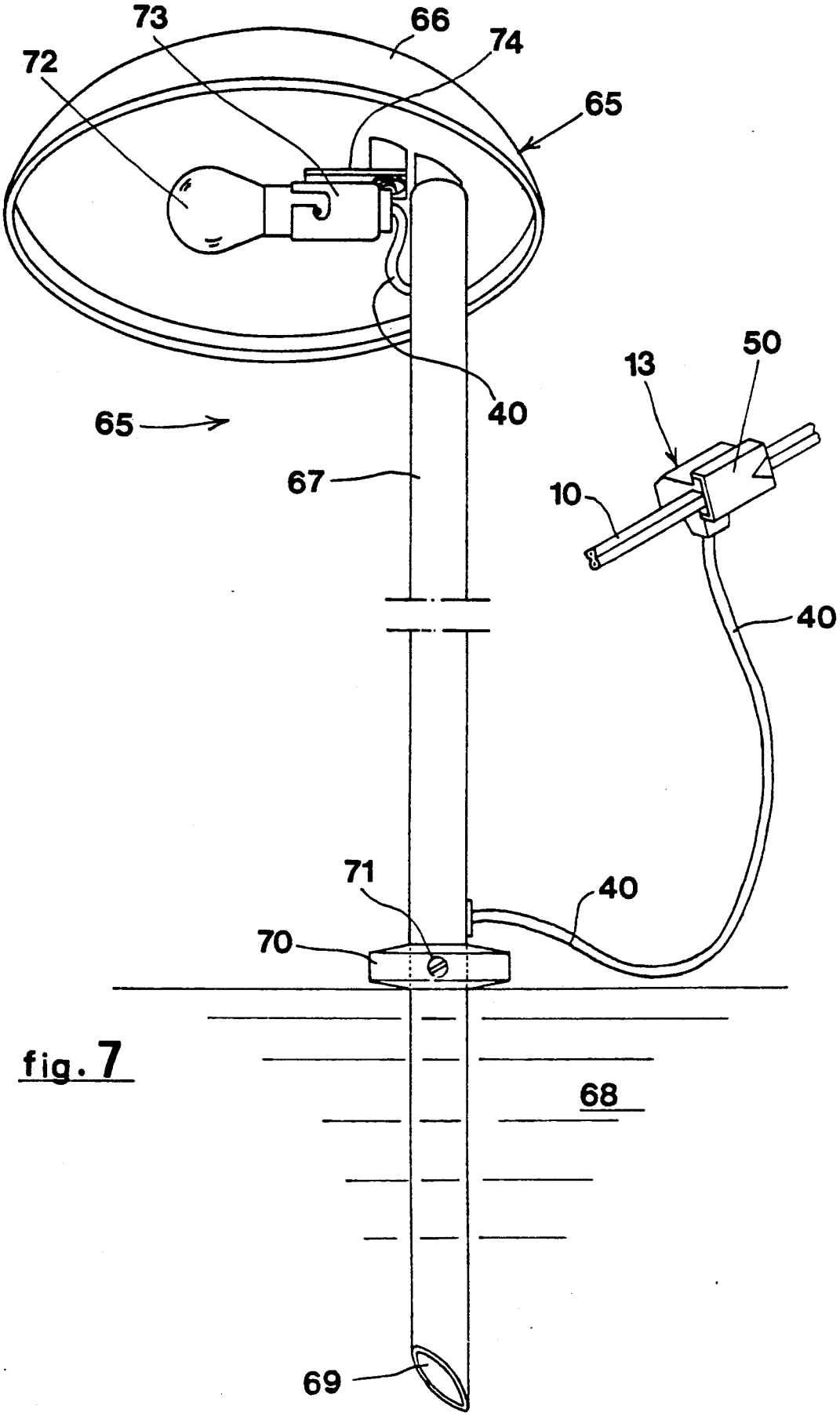
FIG. 7 is a perspective view of a lamp connected in the lighting system with the terminal box.

FIG. 7 illustrates a lamp 65 with its spherical lamp shade 66 mounted on a tubular rod 67 pressed down into the ground 68. Driving the rod down is facilitated by its end 69 being cut at an angle of 45°. The ring nut secured on the tubular rod 67 with its screw 71, marks the regulation height to be maintained between the ground and the source of light 72 consisting of a light bulb of the kind used for automobile lamps, fitting by means of a bayonet connection into the lampholder 73 fixed to the lamp shade 66 by a bracket 74.

The branch cable 40 passes inside the tubular rod 67 and emerges below where it is connected to the terminal box 13.

The terminal box is shown in FIG. 7 mounted on the cable 10. The box cover 50 has already been fitted onto the box which is thereby securely closed.

I claim:

1. Outdoor lighting system comprising a plurality of lamps, each of said lamps having a branch cable containing two electrically conducting wires for feeding electricity thereto;

a supply cable containing two side-by-side electrically conducting wires in sheaths, said supply cable having an indefinite length, a thickness and a width, said electrically conducting wires of said supply cable being connected at one end of said supply cable to means for supplying electricity; and a terminal box made of an insulating material and substantially parallelpiped in shape for detachable connection of each of said branch cables with said supply cable at any point along said supply cable, said terminal box comprising an oblong body having an axial longitudinal channel having a channel width and channel depth substantially equal to said width and said thickness of said supply cable respectively, and projecting side wall portions extending outwardly from said channel, said oblong body having two contacts, each of said contacts being connected electrically to a respective one of said wires of said branch cable, extending through said oblong body and having a point protruding from a bottom surface of said channel and being positioned for connection with said wire of said supply cable; and a slide-on cover for said oblong body, said slide-on cover being formed with a C-shaped cross section and having an inner cover base and longitudinally extending cover sides at opposite lateral edges of said cover base, said cover sides being provided with lateral opposing grooves so that said outwardly projecting side wall portions of said oblong body can engage in said lateral opposing grooves when said slide-on cover is secured to said oblong body, both of said grooves decreasing in width from one end of said slide-on cover to another end thereof; and said slide-on cover also having longitudinal ridges on said cover base extending over a full length of said cover and having a height increasing from said one end of said slide-on cover to said other end; so that, when said grooves at said one end of said cover engage said projecting side wall portions of said oblong body, said cover can be slid on said oblong body of said terminal box with said side wall portions sliding in said grooves of said slide-on cover and said supply cable is pressed onto said points of said contacts as said cover travels over said oblong body and said points pass through said sheaths of said two wires of said supply cable to make contact with said two wires of said supply cable, an amount of movement of said supply cable toward said points of said contacts being due to both said increase in said height of said ridges and said decrease in width of said grooves from said one end to said other end of said cover; and the pressure of said ridges on said supply cable gradually increases as said cover is slid on the oblong body, whereby a waterproof seal is formed between said cover and said oblong body.

2. Outdoor lighting system as defined in claim 1, wherein said slide-on cover is provided with two of said longitudinal ridges, a lateral distance between said ridges corresponding to a distance between said two wires of said supply cable, and said ridges being positioned on opposing sides of a longitudinal axis of said cover, so that, when said slide-on cover travels over said oblong body, said ridges engage said supply cable so as to transmit pressure from said slide-on cover with maximum effectiveness and minimum friction to push said supply cable toward said points of said contacts as said slide-on cover is being slid on said oblong body.

* * * * *